US006199875B1

(12) United States Patent
Nast

(10) Patent No.: US 6,199,875 B1
(45) Date of Patent: Mar. 13, 2001

(54) TILTING APPARATUS HAVING ACTUATORS, AND A TILTING BOGIE HAVING ACTUATORS

(75) Inventor: Jean Daniel Nast, Le Creusot (FR)

(73) Assignee: GEC Alsthom Transport SA, Paris (FR)

( * ) Notice: Subject to any disclaimer, the term of this patent is extended or adjusted under 35 U.S.C. 154(b) by 0 days.

(21) Appl. No.: 09/163,157

(22) Filed: Sep. 30, 1998

(30) Foreign Application Priority Data

Nov. 20, 1997 (FR) ..... 97 14565

(51) Int. Cl.[7] ..... B60G 17/00

(52) U.S. Cl. ..... 280/6.15; 280/6.155; 105/199.2

(58) Field of Search ..... 280/6.15, 6.155, 280/6.156, 124.103, 124.106, 6.157, 6.159, 6.151, 6.152, 6.154; 180/41; 105/199.1, 199.2

(56) References Cited

U.S. PATENT DOCUMENTS 4,069,767 * 1/1978 Glaze ..... 105/164
5,255,611 * 10/1993 Schneider ..... 105/199.2
5,636,576 * 6/1997 Gimenez et al. ..... 105/199.2

FOREIGN PATENT DOCUMENTS 37 199 907 A1 11/1988 (DE) .
42 41 929 A1 6/1994 (DE) .
0 189 382 A2 7/1986 (EP) .
0 736 438 A2 10/1996 (EP) .

* cited by examiner

*Primary Examiner*—Brian L. Johnson
*Assistant Examiner*—Faye M. Fleming
(74) *Attorney, Agent, or Firm*—Sughrue, Mion, Zinn, Macpeak & Seas, PLLC

(57) ABSTRACT

A tilting apparatus for tilting a body (4) of a vehicle, the apparatus being disposed in a bogie underframe, and secondary suspensions (3) being disposed under the body (4) of the vehicle, the tilting apparatus being characterized in that it includes first and second tilt-control actuators (1, 2) disposed rigidly and vertically in the bogie, the secondary suspensions (3) lying under the body (4) of the vehicle and on the tilt-control actuators (1, 2), a re-centering actuator (5) secured via one of its ends to the bogie underframe (6) and via its other end to the body (4) of the vehicle, and an anti-roll bar (7) disposed under the body (4), the tilting apparatus being provided neither with an inclination cross-member, nor with cross-member suspension connection rods.

7 Claims, 4 Drawing Sheets

TILTING APPARATUS HAVING ACTUATORS, AND A TILTING BOGIE HAVING ACTUATORS

BACKGROUND OF THE INVENTION

The present invention relates generally to vehicles whose bogies tilt to compensate for insufficient banking, and more particularly to tilting apparatus having actuators, and to a tilting bogie having actuators.

Document EP 0 189 382 relates to links between the bogies and the underframe of a rail vehicle.

FIG. 5 of that prior art document shows a rail vehicle in which each bogie tilts to compensate for insufficient banking by applying a heeling angle to an inclination cross-member and thus to the body of the vehicle.

Such compensation by tilting is obtained by means of tilting apparatus having connection rods.

That prior art tilting apparatus having connection rods includes an inclination cross-member disposed in a bogie underframe and suspended by means of connection rods.

The tilting movement between the inclination cross-member and the bogie underframe is obtained by the presence of balls at the ends of the connection rods.

As described in that prior art document, primary suspensions are disposed between the bogie underframe and the axle boxes, secondary suspensions are disposed between the inclination cross-member and the body of the vehicle.

In such prior art tilting apparatus having connection rods, the drive forces between the bogie underframe and the body of the vehicle are taken up by the connection rods.

A drawback of the prior art tilting apparatus is the lack of empty volume in the central portion of the bogie.

Another drawback of the prior art tilting apparatus is its high cost and weight.

SUMMARY OF THE INVENTION

An object of the invention is to provide tilting apparatus and a tilting bogie that do not suffer from the drawbacks of prior art tilting apparatus and of prior art tilting bogies.

According to the invention, the tilting apparatus for tilting a body of a vehicle, which apparatus is disposed in a bogie underframe, secondary suspensions being disposed under said body of the vehicle, is characterized in that it comprises first and second tilt-control actuators disposed rigidly and vertically in said bogie, said secondary suspensions lying under said body of said vehicle and on said tilt-control actuators, a re-centering actuator secured via one of its ends to the bogie underframe and via its other end to said body of the vehicle, and an anti-roll bar disposed under said body, said tilting apparatus being provided neither with an inclination cross-member, nor with cross-member suspension connection rods.

The tilting apparatus of the invention also satisfies at least one of the following characteristics:

said anti-roll bar comprises a transverse bar and two vertical connection rods, said transverse bar being disposed under said body and the free ends of said vertical connection rods being disposed in the bottom portion of said secondary suspensions;

said anti-roll bar comprises a transverse bar and two vertical connection rods, said transverse bar being disposed in the bottom portion of said secondary suspensions, and the free ends of said vertical connection rods being disposed under said body;

said tilt-control actuators are hydraulically controlled;

the lower chambers of said control actuators are interconnected by means of a hydraulic link;

said tilt-control actuators are electromechanically controlled; and said secondary suspensions are provided with supports.

According to the invention, the tilting bogie is characterized in that it includes tilting apparatus according to any of the preceding characteristics.

An advantage of the tilting apparatus and of the tilting bogie of the invention is that the weight per bogie is reduced by an amount approximately in the range 300 kg to 500 kg.

Another advantage of the tilting apparatus and of the tilting bogie of the invention is to enable railcars to be brought level with platforms by adjusting the positions of the control actuators.

BRIEF DESCRIPTION OF THE DRAWING

Other objects, characteristics and advantages of the invention appear on reading the following description of a preferred embodiment of the tilting apparatus and of the tilting bogie, the description being given with reference to the drawings, in which.

DETAILED DESCRIPTION OF THE INVENTION

Figure 1:
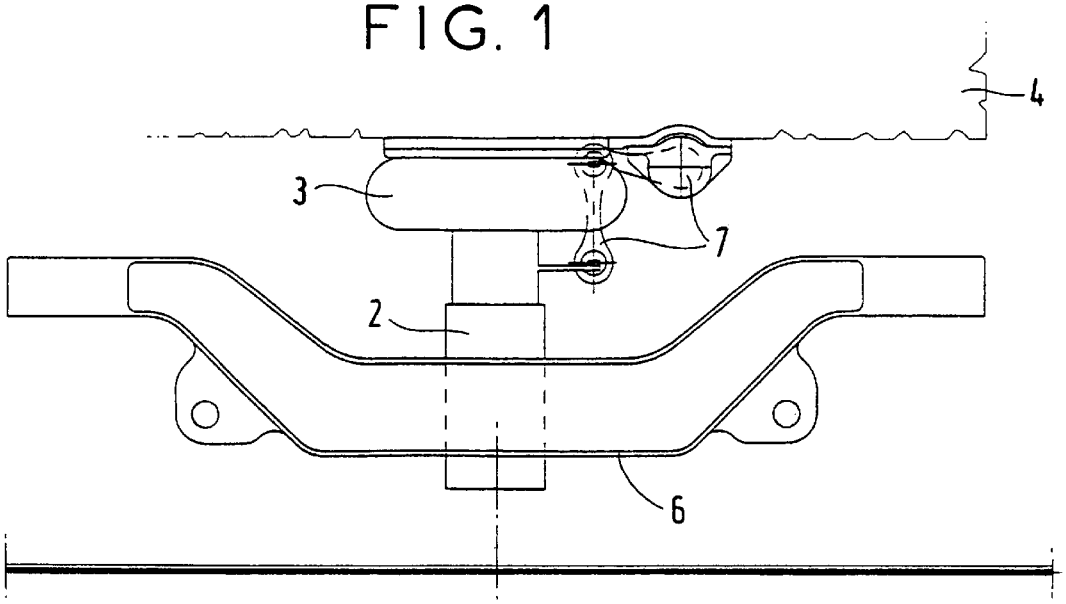
FIG. 1 is a side view of a first embodiment of the tilting apparatus of the invention, in which an anti-roll bar is disposed on the body.
Figure 2:
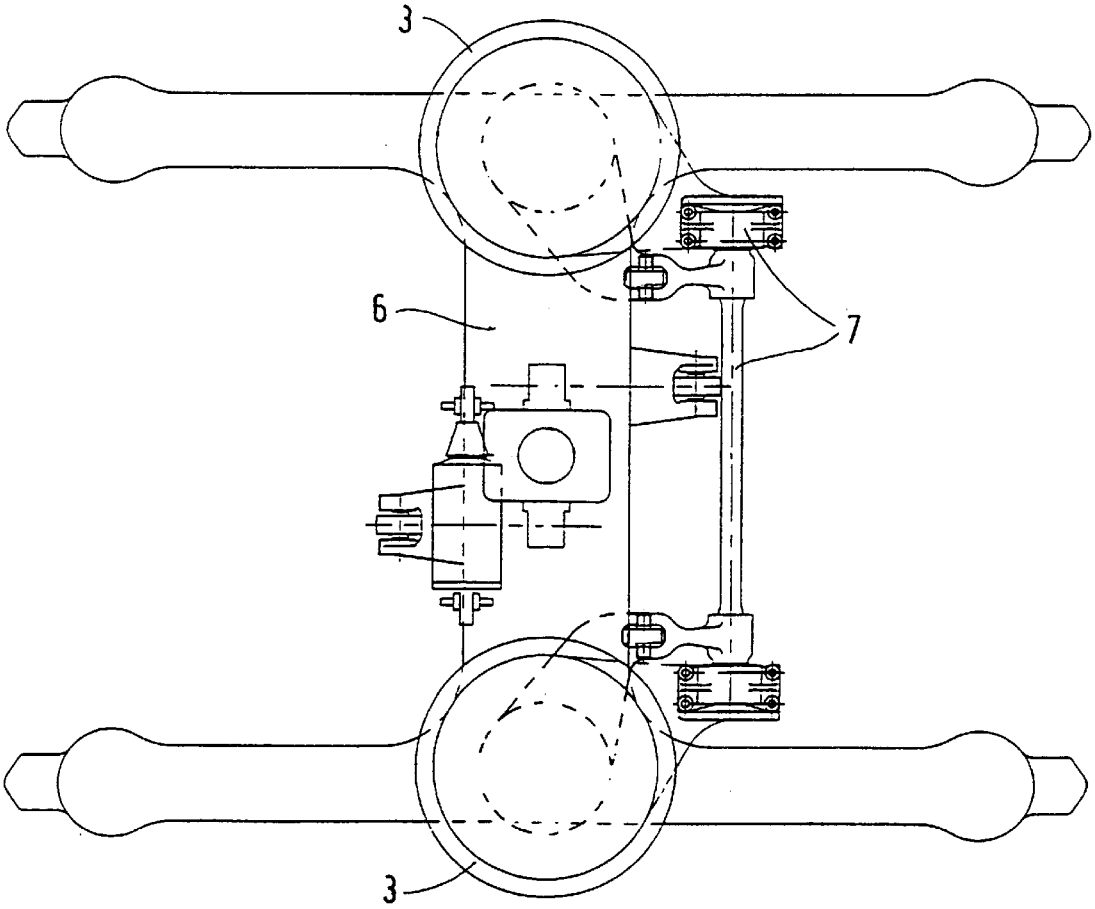
FIGS. 2 and 3 are respectively a plan view and a front view partially in section of the first embodiment of the tilting apparatus of the invention.
Figure 3:
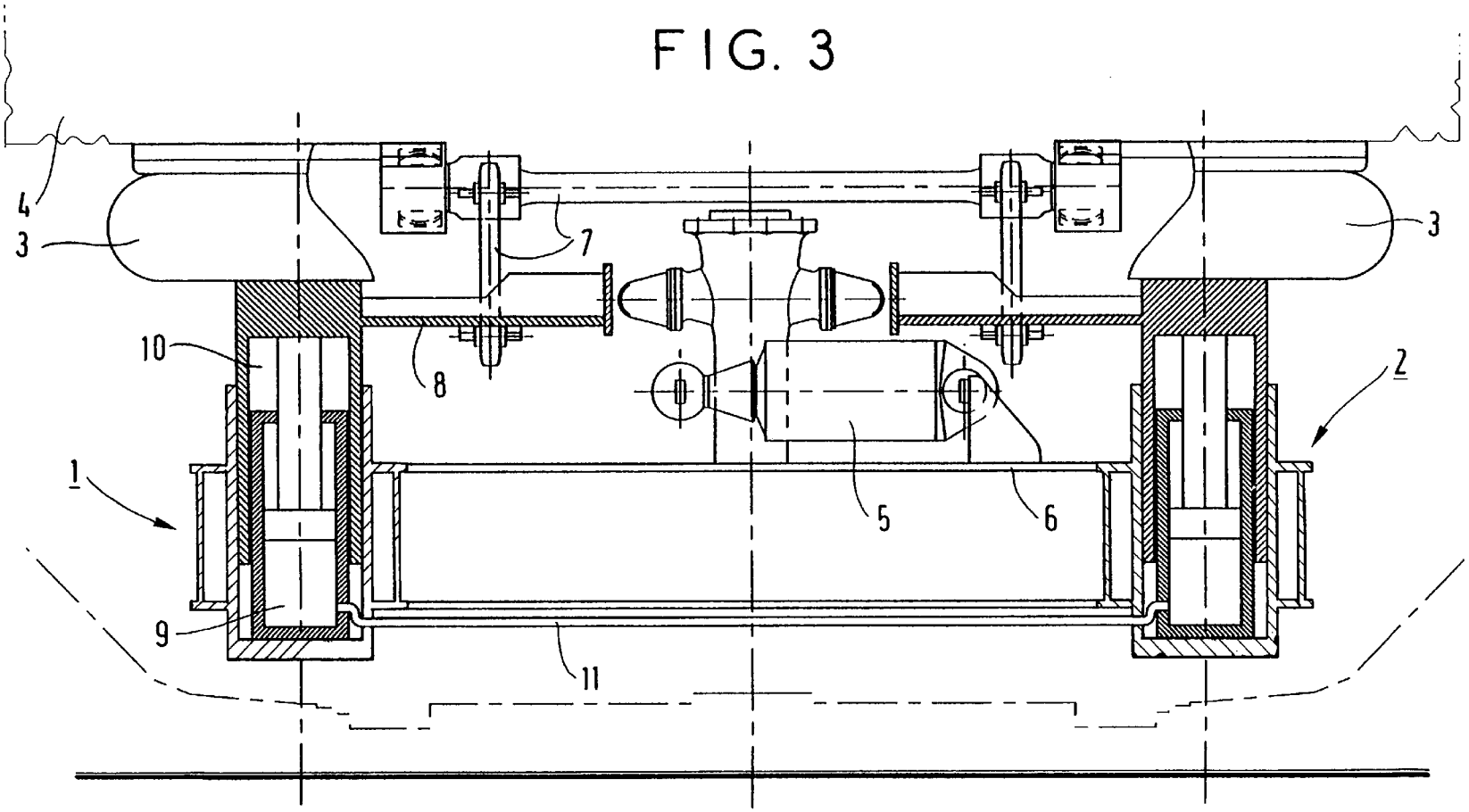

FIGS. 1 to 3 are respectively a side view, a plan view, and a front view partially in section of a first embodiment of the tilting apparatus of the invention, in which an anti-roll bar is disposed on the body.

Figure 4:
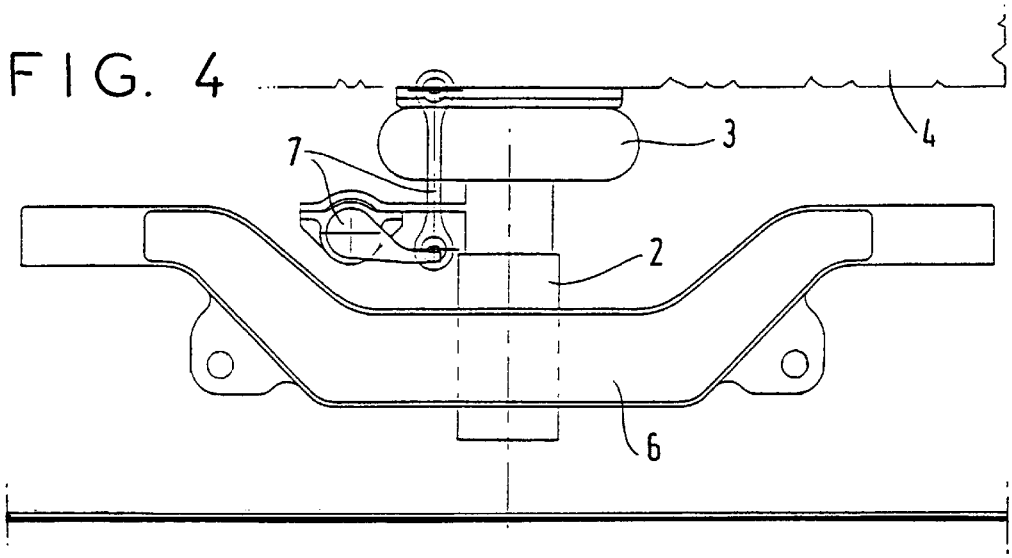
FIG. 4 is a side view of a second embodiment of the tilting apparatus of the invention, in which an anti-roll bar is disposed on the supports of the secondary suspension.
Figure 5:
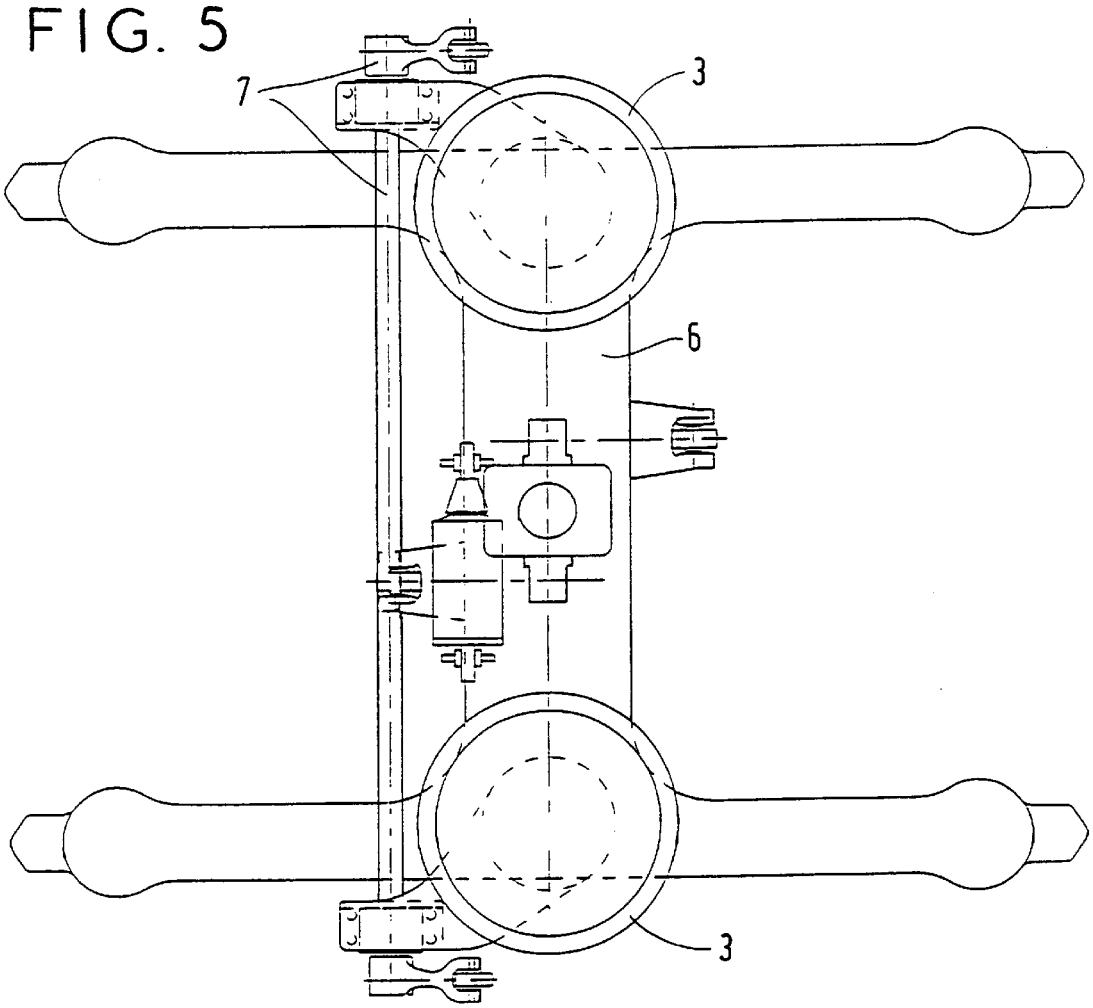
FIGS. 5 and 6 are respectively a plan view and a front view partially in section of the second preferred embodiment of the tilting apparatus of the invention.
Figure 6:
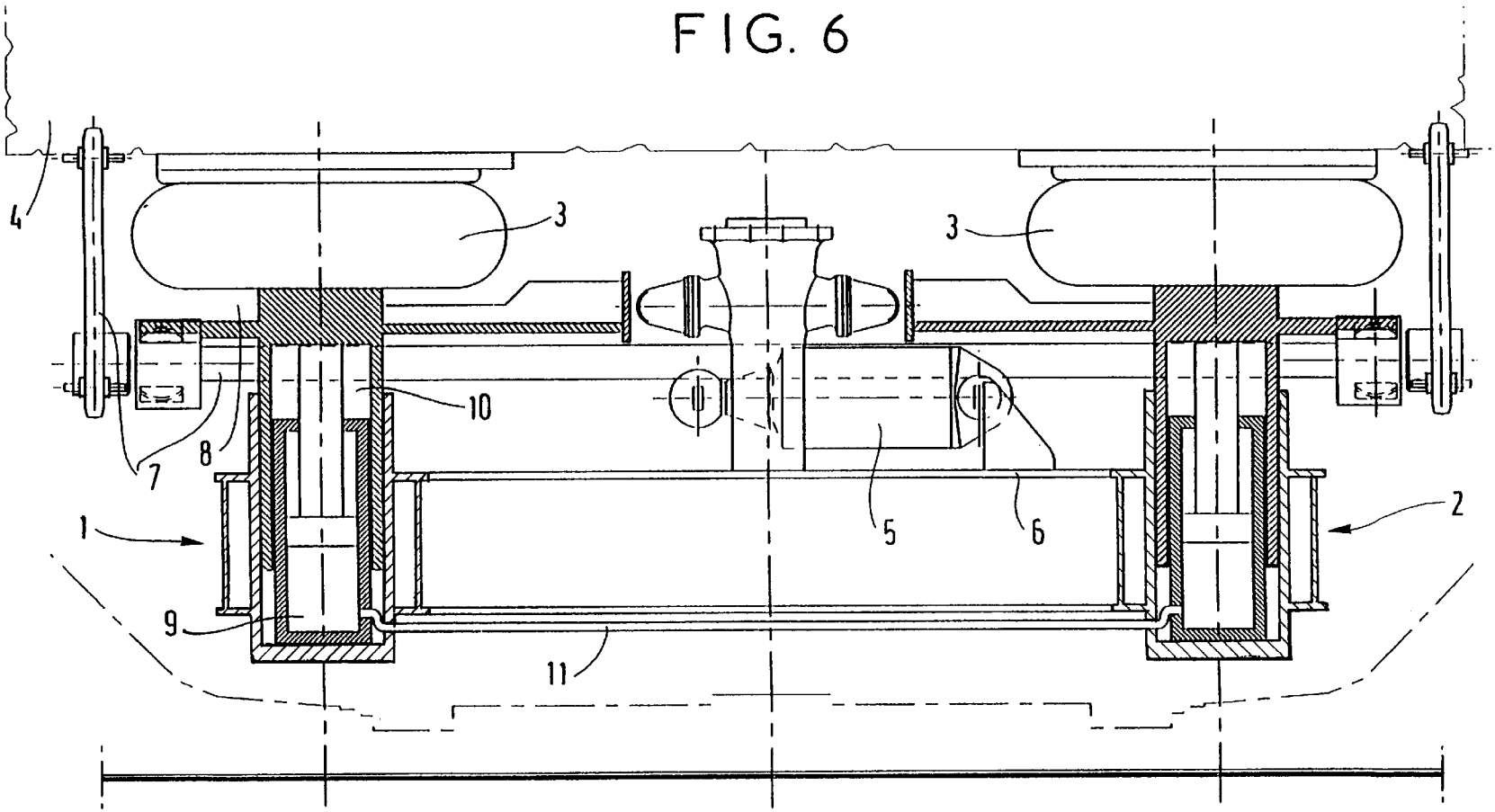

FIGS. 4 to 6 are respectively a side view, a plan view, and a front view partially in section of a second embodiment of the tilting apparatus of the invention, in which an anti-roll bar is disposed on the supports of the secondary suspension.

The bogie tilting apparatus of the invention comprises first and second tilt-control actuators 1 and 2 disposed rigidly and vertically in the bogie.

The secondary suspensions 3 lie under the body 4 of the vehicle and on the tilt-control actuators 1, 2, e.g. via supports 8.

The body of the vehicle is inclined under the action of the tilt-control actuators 1, 2, while the secondary suspension 3 is kept flexible by means of a re-centering actuator 5.

The re-centering actuator 5 is secured via one of its ends to the bogie underframe 6 and via its other end to the body 4 of the vehicle.

An anti-roll bar 7 is disposed under the body 4.

The anti-roll bar 7 comprises a transverse bar and two vertical connection rods.

In the first embodiment of the tilting apparatus of the invention, shown in FIGS. 1 to 3, the transverse bar is disposed under the body 4, and the free ends of the vertical connection rods are disposed in the lower portion of the secondary suspensions 3, e.g. on the supports 8 of the secondary suspensions.

In the second embodiment of the tilting apparatus of the invention, shown in FIGS. 4 to 6, the transverse bar is disposed in the lower portion of the secondary suspensions 3, e.g. on the supports 8 of the secondary suspensions, and the free ends of the vertical connection rods are disposed under the body 4.

The tilt-control actuators 1, 2 are preferably controlled either hydraulically or electromechanically.

When the tilt-control actuators 1 are hydraulically controlled, the lower chambers 9 of the control actuators 1, 2 are interconnected by means of a hydraulic link 11.

An advantage of the hydraulic link 11 between the lower chambers 9 of the control actuators 1, 2 is that, when the vehicle is standing at a station, it is possible to put the railcars level with the platform by regulating the pressure in the lower chambers 9 of the control actuators 1, 2.

In such tilting apparatus of the invention, the bogie tilting to compensate for insufficient banking by applying a heeling angle is achieved by means of the upper chamber 10 of one of the tilt-control actuators 1, 2 being pressurized.

Clearly, when the tilt-control actuators 1, 2 are electromechanically controlled, tilting to compensate for insufficient banking by applying a heeling angle or to bring railcars level with the platform is achieved by regulating the positions of the control actuators 1, 2.

The present invention also relates to a tilting bogie provided with tilting apparatus as described above.

What is claimed is:

1. Tilting apparatus for tilting a body (4) of a vehicle, the apparatus being disposed in a bogie underframe, and secondary suspensions (3) being disposed under said body (4) of the vehicle, said tilting apparatus being characterized in that it comprises first and second tilt-control actuators (1, 2) disposed rigidly and vertically in said bogie underframe, said secondary suspensions (3) lying under said body (4) of said vehicle and on said tilt-control actuators (1, 2), a re-centering actuator (5) secured via one of its ends to the bogie underframe (6) and via its other end to said body (4) of the vehicle, and an anti-roll bar (7) disposed under said body (4), said tilting apparatus being provided neither with an inclination cross-member, nor with cross-member suspension connection rods.

2. Apparatus according to claim 1, in which said anti-roll bar (7) comprises a transverse bar and two vertical connection rods, said transverse bar being connected to said body (4) and the free ends of said vertical connection rods being connected to in the bottom portion of said secondary suspensions (3).

3. Apparatus according to claim 1, in which said anti-roll bar (7) comprises a transverse bar and two vertical connection rods, said transverse bar being connected to in the bottom portion of said secondary suspensions (3), and the free ends of said vertical connection rods being connected to said body (4).

4. Apparatus according to claim 1, in which said tilt-control actuators (1, 2) are hydraulically controlled.

5. Apparatus according to claim 4, in which the lower chambers (9) of said control actuators (1, 2) are interconnected by means of a hydraulic link (11).

6. Apparatus according to claim 1, in which said secondary suspensions (3) are provided with supports (8).

7. A tilting bogie, characterized in that it includes tilting apparatus according to claim 1.

* * * * *